United States Patent [19]

Uehiro et al.

[11] 4,196,780

[45] Apr. 8, 1980

[54] HYDRAULIC PERCUSSION DRILL

[75] Inventors: Takayuki Uehiro, Hirakata; Hatsuji Doi, Fujiidera; Shuichiro Miwa, Hirakata, all of Japan

[73] Assignee: Kabushiki Kaisha Komatsu Seisakusho, Tokyo, Japan

[21] Appl. No.: 904,299

[22] Filed: May 9, 1978

[51] Int. Cl.[2] ..... B25D 9/00; F01L 31/00

[52] U.S. Cl. ..... 173/115; 173/DIG. 4; 91/277

[58] Field of Search ..... 173/115, 134, DIG. 4; 91/245, 277, 319, 321

[56] References Cited

U.S. PATENT DOCUMENTS

| | | | |
|---|---|---|---|
| 1,219,932 | 3/1917 | Frost | 173/115 |
| 3,032,013 | 5/1962 | Vincent | 91/277 X |
| 3,185,040 | 5/1965 | Ligon | 91/277 |
| 3,701,386 | 10/1972 | Feucht | 173/78 |
| 3,995,700 | 12/1976 | Mayer et al. | 173/115 X |
| 4,016,941 | 4/1977 | Sanders | 91/277 X |
| 4,062,411 | 12/1977 | Adkins et al. | 173/115 |

FOREIGN PATENT DOCUMENTS

| | | | |
|---|---|---|---|
| 1298753 | 7/1969 | Fed. Rep. of Germany | 91/319 |

*Primary Examiner*—Lawrence J. Staab

*Attorney, Agent, or Firm*—Armstrong, Nikaido, Marmelstein & Kubovcik

[57] ABSTRACT

A percussion drill comprising a cylinder housing, a striker piston slidably accommodated within said housing, a shank rod slidably mounted within said housing, said shank rod being adapted to be struck by said striker piston, a first chamber having a small sectional area continuously pressurized by hydraulic fluid for retracting said striker piston, a second chamber having a large sectional area intermittently pressurized by hydraulic fluid for advancing said striker piston, a selector valve mounted in said housing, said selector valve being connected with said first and second chambers, and a bushing adjustably mounted in said housing around the periphery of said striker piston so as to form a pilot operated valve between said bushing and the periphery of said piston.

2 Claims, 1 Drawing Figure

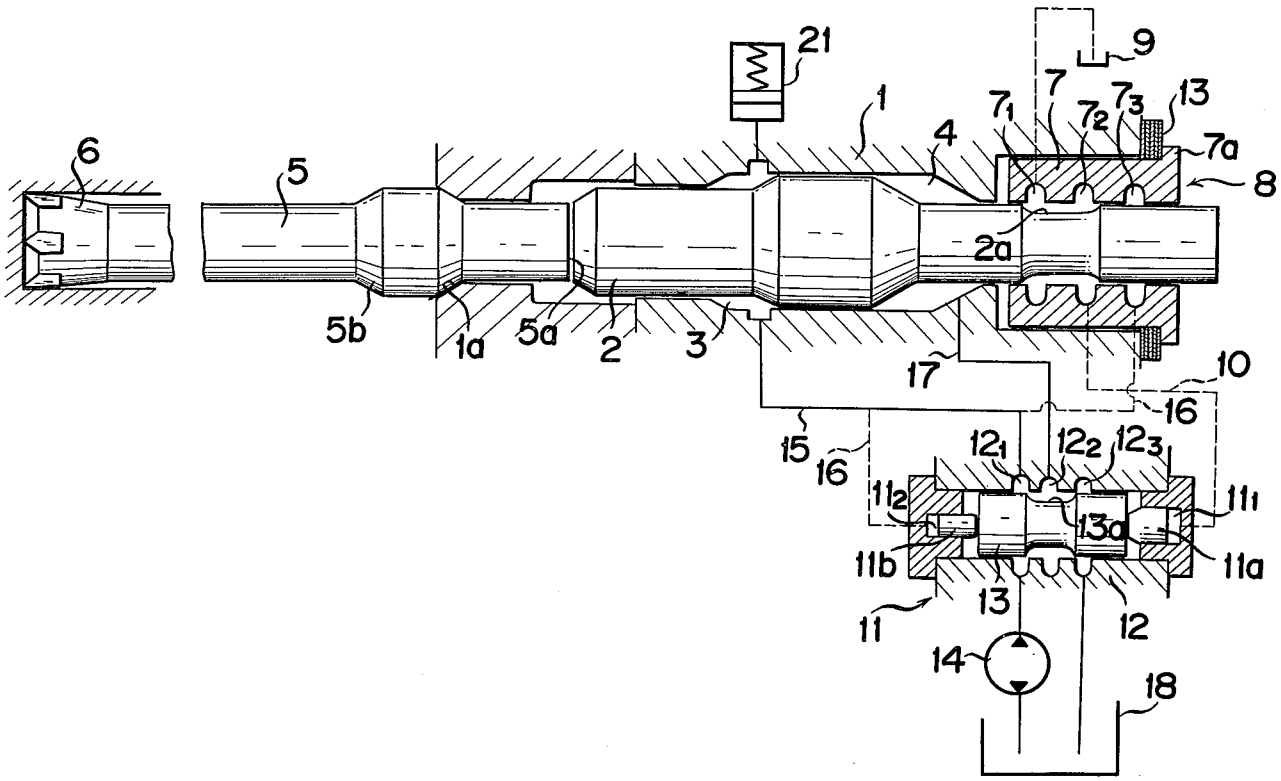
8
7a
13
9
7₃
7₂
7
7₁
4
1
21
2a
10
16
17
15
16
3
2
5a
1a
5b
5
6
11₁
11a
12₃
12₂
12₁
13a
12
13
14
18
11₂
11b
11

HYDRAULIC PERCUSSION DRILL

BACKGROUND OF THE INVENTION

This invention relates to an improvement in a hydraulic percussion drill for drilling rocks or the like by its shank rod or chisel percussed by a striker piston adapted to reciprocate by a hydraulic pressure.

The hydraulic percussion drill of the kind specified which has heretofore been employed comprises a striker piston and a pilot valve formed as an integral unit thereof, and the arrangement is made such that the reciprocation of the striker piston generates a pilot pressure and the change-over of a hydraulic change-over valve by the pilot pressure causes continuous reciprocation of the striker piston. The abovementioned conventional hydraulic percussion drill has a pilot port for the pilot valve formed in the upper part of a cylinder in which the striker piston is accommodated. Such conventional hydraulic percussion drill is disadvantageous in that if it is put to use for an extended period of time the striker faces of the striker piston and the shank rod tend to wear down so as to cause reciprocation of the striker piston beyond its optimum stroke thereby causing incorrect operational relationship between the pilot valve spool and the port so that a predetermined percussion energy cannot be obtained.

SUMMARY OF THE INVENTION

It is therefore an object of the present invention to provide a hydraulic percussion drill which can overcome the above-mentioned disadvantages and provide an optimum striking timing of a striker piston by adjusting the stroke thereof.

Another object of the present invention is to provide a hydraulic percussion drill which can always give an optimum striking timing of the striker piston even when the striking surfaces of the striker piston and the shank rod to be struck have been worn out.

In accordance with an aspect of the present invention, there is provided a hydraulic percussion drill comprising a cylinder housing, a striker piston slidably accommodated within said housing, a shank rod slidably mounted within said housing, said shank rod being adapted to be struck by said striker piston, a first chamber having a small sectional area continuously pressurized by hydraulic fluid for retracting said striker piston, a second chamber having a large sectional area intermittently pressurized by hydraulic fluid for advancing said striker piston, said first and second chambers being defined between said housing and said striker piston, and a selector valve mounted in said housing and connected with said first and second chambers.

A bushing is adjustably mounted, in the axial direction of said piston, within said housing around the periphery of said striker piston at one end thereof, said bushing having circular grooves formed therein and a flange formed at one end thereof, said striker piston having a reduced diameter portion at and around the grooves of said bushing so as to form a pilot operated valve between said bushing and the periphery of said striker piston. The circular grooves of said bushing are connected with either said selector valve or drainage.

Shims are sandwiched between said housing and the flange of said bushing in order to adjust the position of said bushing in the axial direction of said striker piston thereby allowing an optimum timing of said striker piston for striking said rod to be obtained.

The above and other objects, features and advantages of the present invention will be readily apparent from the following description taken in conjunction with the accompanying drawing.

BRIEF DESCRIPTION OF THE DRAWING

The accompanying drawing shows a schematical cross-section of a hydraulic percussion drill according to the present invention.

DETAILED DESCRIPTION OF THE INVENTION

The present invention will now be described in detail by way of example only with reference to the accompanying drawing. In the drawing, reference numeral 1 denotes a cylinder forming the body of the hydraulic percussion drill in which a striker piston 2 is accommodated. The cylinder 1 is divided into a front chamber 3 and a rear chamber 4. One end of the striker piston 2 abuts against a striker face 5*a* of a shank rod 5 reciprocably mounted in the lower part (in the left hand portion in the drawing) of the cylinder 1. The shank rod 5 has a bit 6 mounted on the leading end thereof. Further, the shank rod 5 has at its base a reaction force carrier member 5*b* supported by a supporting portion 1*a* of the cylinder 1 to limit the upward stroke of the shank rod 5. The other end of the striker piston 2 is accommodated in an adjusting bushing 7 which is adjustably and removably mounted in the upper part (in the right hand part in the drawing) of the cylinder 1. The adjusting bushing 7 forms a pilot valve 8 between the bushing per se and a reduced diameter portion 2*a* of the striker piston 2, and has three sets of pilot ports $7_1$, $7_2$ and $7_3$ formed therein so as to surround the reduced diameter portion 2*a*. The port $7_1$ leads to drain 9; the central port $7_2$ leads through a conduit 10 to a cylinder $11_1$ of a hydraulic pressure change-over valve 11, and the port $7_3$ leads through a conduit 16 to other cylinder $11_2$ of the hydraulic pressure change-over valve 11. The adjustment of position of the adjusting bush 7 can be accomplished by, for example, interposing a shim 13 of a proper thickness between a flange portion 7*a* and the upper face of the cylinder 1.

The above-mentioned hydraulic pressure change-over valve 11 is built in the cylinder 1 and is constructed as mentioned below.

In brief, accommodated within the valve body 12 is a spool 13 having a reduced diameter portion at its centre, and three sets of ports $12_1$, $12_2$ and $12_3$ are formed to surround the spool 13. Out of the ports $12_1$ to $12_3$, the port $12_1$ is connected through a hydraulic pump 14 and a conduit 15 to the above-mentioned lower chamber 3, and a part of the conduit 15 is connected to a conduit 16 which leads to the cylinder $11_2$. Further, the port $12_2$ communicates by the conduit 17 with the piston upper chamber 4, and the port $12_3$ is connected to drain tank 18. The leading ends of pistons 11*a* and 11*b* having different diameters and accommodated in the cylinders $11_1$ and $11_2$, respectively, abut against both ends of the spool 13 so that the spool 13 can be changed over by the pilot pressure introduced into the cylinders $11_1$ and $11_2$. Further, reference numeral 21 indicates an accumulator communicating with the lower chamber 3. Thus, the fluid under pressure delivered by the hydraulic pump 14 is supplied into the ports $12_1$ and $12_2$ which are communicated by the spool's reduced diameter portion 13*a* of the hydraulic pressure change-over valve 11, and then supplied through the conduits 15 and 17 into the front chamber 3 and the rear chamber 4, respectively. Consequently, because of the difference of cross-sectional area between the front and rear chambers 3 and 4, the striker piston 2 is moved leftwards. At the same time, a part of the fluid under pressure flows into the cylinder $11_2$ of the hydraulic pressure change-over valve 11 so that the piston 11*b* can urge the spool 13 rightwards in the drawing. When the striker piston 2 reaches a position immediately before striking the shank rod 5, the spool 13 of the hydraulic pressure change-over valve 11 will communicate the ports $12_1$ and $12_2$ with the drain port $12_3$ so that the fluid under pressure in the front and rear chambers 3 and 4 is drained through the port $12_3$ and the shank rod 5 is struck by the striken piston 2 being advanced by the inertia. Thereafter, the spool 13 cuts off the communication between the ports $12_1$ and $12_2$ so that the pressurized fluid deliverred by the hydraulic pump 14 is supplied into the lower chamber 3 so as to move the striker piston 2 backwards. When the reduced diameter portion 2*a* of the striker piston 2 is connected to the port $7_3$, a part of the pressurized fluid supplied into the front chamber 3 flows through the conduit 16 and the ports $7_3$ and $7_2$ into the cylinder $11_1$ of the hydraulic pressure change-over valve 11. As a result, because of the difference of area subjected to hydraulic pressure, the larger diameter piston 11*a* can overcome the small diameter piston 11*b* so that the spool 13 is urged leftwards. When the spool 13 shields the port $12_3$ and communicates the ports $12_2$ and $12_1$, the pressurized fluid can flow into the front and rear chambers 3 and 4, and because of the difference in area subjected to hydraulic pressure, the backwardly moving striker piston 2 is gradually decelerated and then stopped. Further, during the period between the front chamber 3 is allowed to communicate with the rear chamber 4 and the time the backward movement of the striker piston 2 is stopped, the hydraulic fluid displaced by the striker piston 2 will be introduced into the accumulator 21 communicating with the front chamber 3 so as to be ready for discharge when the striker piston 2 strikes the shank rod.

Though the operation of the hydraulic percussion drill has been described hereinabove, when the drill is used for an extended period of time, striking face 5*a* of the shank rod 5 and the reaction force carrier member 5*b* adapted to limit the upward stroke of the shank rod 5 will be worn out, and as a result, the position where the striker piston 2 strikes against the shank rod 5 is will vary. If the stroke of the striker piston 2 becomes shorter than the normal, the striker piston 2 will strike against the shank rod 5 without being sufficiently accelerated; and reversely, when the stroke of the striker piston 2 becomes longer, the spool 13 of the hydraulic pressure change-over valve 11 will cut off the communication between the ports $12_1$ and $12_2$ and communicate the rear chamber 4 with the drain port $12_3$ so that the striker piston 2 will strike against the shank rod 5 after the commencement of deceleration thereof. In either case, the striking force will be remarkably reduced. As a counter-measure for this, when a change of the striking position took place due to wear-down of the shank rod 5, the adjusting bushing 7 is adjusted by interposing shim 13 between the end face of the cylinder 1 and the flange 7*a* so as to keep the stroke of the striker piston 2 at a proper value thereby enabling a proper striking position to be obtained. Stated more specifically, when the adjusting bushing 7 is moved forwards, the optimum striking position of the striker piston 2 is moved forwards, and reversely when the bushing is moved rearwards, the optimum striking position is moved rearwards so that the optimum striking position can always be obtained only by adjusting the amount of movement of the adjusting bushing 7 in response to the amount of change of the striking position. Further, a desired number of percussions and striking force can be obtained by previously changing the delivery volume of the hydraulic pump 14 and adjusting the stroke of the striker piston 2 by means of the adjusting bushing 7.

While the invention has been described and shown with particular reference to the preferred embodiment, it will be apparent that variations and modifications might be possible that would fall within the scope of the present invention, which is not intended to be limited except as defined in the following claims.

What is claimed is:

1. In a percussion drill including a cylinder housing, a striker piston slidably accommodated within said housing, a shank rod slidably mounted within said housing, said shank rod being adapted to be struck by said striker piston, a first chamber having a small cross-sectional area continuously pressurized by hydraulic fluid for retracting said striker piston, a second chamber having a large cross-sectional area intermittently pressurized by hydraulic fluid for advancing said striker piston, said first and second chambers being formed between said housing and said striker piston, and a selector valve mounted in said housing, said selector valve being connected with said first and second chambers, the improvement comprising a bushing adjustably mounted in the axial direction of said piston within said housing around the periphery of said striker piston at one end thereof, said bushing having circular grooves formed therein and a flange formed at one end thereof, said striker piston having a reduced diameter portion positioned with respect to the grooves of said bushing to form a pilot operated valve between said bushing and the periphery of said striker piston, the circular grooves being connected with said selector valve, and means for adjusting the position of said bushing in the axial direction of said piston for adjusting the location of the point in the forward movement of said striker piston at which said striker piston strikes said shank rod such that said striker piston strikes said shank rod at the optimum point of the forward movement thereof.

2. The percussion drill as defined in claim 1 wherein said means for adjusting the position of the bushing comprises a shim sandwiched between said housing and the flange of said bushing.

* * * * *